US007552882B2

(12) United States Patent
Matsumoto et al.

(10) Patent No.: US 7,552,882 B2
(45) Date of Patent: Jun. 30, 2009

(54) SPRAY GUN FOR ELECTROSTATIC PAINTING

(75) Inventors: Takuya Matsumoto, Yokohama (JP); Yasuhiro Ochii, Yokohama (JP); Atsushi Morohoshi, Yokohama (JP)

(73) Assignee: Anest Iwata Corporation, Kanagawa-ken (JP)

( * ) Notice: Subject to any disclaimer, the term of this patent is extended or adjusted under 35 U.S.C. 154(b) by 411 days.

(21) Appl. No.: 10/533,136

(22) PCT Filed: Oct. 30, 2003

(86) PCT No.: PCT/JP03/13933

§ 371 (c)(1),
(2), (4) Date: Jan. 19, 2006

(87) PCT Pub. No.: WO2004/039502

PCT Pub. Date: May 13, 2004

(65) Prior Publication Data

US 2006/0124782 A1 Jun. 15, 2006

(30) Foreign Application Priority Data

Oct. 31, 2002 (JP) ..... 2002-317850
Nov. 8, 2002 (JP) ..... 2002-325077

(51) Int. Cl.
*B05B 5/053* (2006.01)
*B05B 5/025* (2006.01)
*B05B 5/00* (2006.01)

(52) U.S. Cl. ..... 239/707; 239/691; 239/705

(58) Field of Classification Search ..... 239/290, 239/296, 418, 419, 526, 690, 691, 698, 707–708, 239/DIG. 4

See application file for complete search history.

(56) References Cited

U.S. PATENT DOCUMENTS 3,937,401 A * 2/1976 Luderer et al. ..... 239/707

(Continued)

FOREIGN PATENT DOCUMENTS

JP 53-30646 3/1978

(Continued)

*Primary Examiner*—Darren W Gorman
(74) *Attorney, Agent, or Firm*—Wenderoth, Lind & Ponack, L.L.P.

(57) ABSTRACT

A spray gun for electrostatic painting in which an external electrode sustaining a high voltage can be fixed/removed while sustaining insulation from a spray unit on the ground potential side by limiting current supply to paint appropriately when electrostatic painting is performed using conductive paint, e.g. water based paint, and safety and handling performance are enhanced while ensuring the painting efficiency as the spray gun for electrostatic painting. On the outside of the spray gun (1) having the spray unit (5) at the forward end thereof, the external electrode (7) having an electrode projecting from the forward end part thereof is provided removably at the part (13) of the gun body being connected with the electrode while being separated from the paint passage such that it can be replaced readily. The part being connected with a high voltage output end part through a high resistor for limiting current can be shortened while sustaining safety by providing a turn-up part so that a sufficient creeping discharge preventing distance is ensured up to the exposed part on the outer surface. Furthermore, the electrode body itself is simplified so that it can be replaced with one touch, and it is composed of a flexible resilient material in order to prevent damage.

3 Claims, 5 Drawing Sheets

U.S. PATENT DOCUMENTS

| | | | | | |
|---|---|---|---|---|---|
| 3,952,951 | A | * | 4/1976 | Raetz et al. | 239/705 |
| 4,079,894 | A | | 3/1978 | Harjar et al. | |
| 4,143,819 | A | * | 3/1979 | Hastings | 239/707 |
| 4,157,162 | A | * | 6/1979 | Benedek et al. | 239/707 |
| 4,194,696 | A | * | 3/1980 | Harjar | 239/707 |
| 4,355,764 | A | * | 10/1982 | Rood et al. | 239/708 |
| 4,572,438 | A | * | 2/1986 | Traylor | 239/708 |
| 5,326,031 | A | | 7/1994 | Konieczynski | |

FOREIGN PATENT DOCUMENTS

| | | |
|---|---|---|
| JP | 6-7708 | 1/1994 |
| JP | 6-198228 | 7/1994 |
| JP | 7-213958 | 8/1995 |
| JP | 8-257441 | 10/1996 |
| JP | 2770079 | 4/1998 |

* cited by examiner

SPRAY GUN FOR ELECTROSTATIC PAINTING

TECHNICAL FIELD

The present invention generally relates to a spray gun capable of electrostatically spraying a to-be-painted object with a highly conductive paint such as a water-based paint, metallic paint or the like with an optimum efficiency and an excellent safety and operability. More particularly, the present invention relates to an electrostatic-painting spray gun of an external charging type in which a high voltage is applied to an external electrode disposed in a position off an area sprayed with the paint from the spray gun to cause a discharge at the ground-potential side of the to-be-painted object, thereby forming an electric field in which fine particles of the paint passing through the discharging area are electrostatically charged.

BACKGROUND ART

The electrostatic painting or coating is a widely adopted painting technique in which an electrostatic-painting spray gun is used to coat an object with a paint with a high efficiency by charging fine particles of a paint sprayed are charged with a high-voltage static while forming an electric field on the object. The paints used in such electrostatic painting are generally classified, from the viewpoints of action and effect, into a solvent type high in electrical resistance, and a highly conductive type low in electrical resistance, such as a water-based paint or metallic paint. An appropriate one the painting methods and painting apparatuses should be selected for a selected one of such paints.

Because of the recent movement for being friendly to the earth, it has been demanded to limit the use of the solvent type paints containing a volatile organic compound, and use the water-based paints instead. In the case of the conventional electrostatic-painting spray gun, however, when sprayed fine particles of a paint are directly charged with a high-voltage static to improve the efficiency of electrostatic paint adhesion, the applied voltage goes to a grounded paint supply source via the paint particles, resulting in that no electrostatic effect can be assured and the high voltage arriving at the paint supply source will possibly cause a danger. On this account, there is used an approach to make an electrostatic spraying with the paint supply source being insulated from the ground potential while maintaining the high voltage. However, a vast amount of charge on the paint supply source will inevitably lead to an increased danger. To make a continuous work of painting in order to attain a higher industrial efficiency of painting, it will be necessary to use a paint feeder as disclosed in the Japanese Patent Application Laid Open No. 198228 of 1994. It is required to introduce a larger-scale painting apparatus not readily usable and of which the maintenance is not easy. These problems cause the electrostatic spraying of water-based and metallic paints not to have been more prevailing and the environmental pollution not to be limited or stopped early and effectively.

In the field of electrostatic painting. there are well known the direct charging technique in which fine particles of a paint are directly charged and also the external charging technique in which paint particles are not directly charged but they are charged when passing through an air space ionized by discharging from an external electrode disposed outside a sprayed area, carried on electric lines of force (electric field) formed toward a to-be-painted object, and adhere or stick to the latter. For example, electrostatic-painting painting apparatuses formed each integrally with a spray gun and cooperating with the latter are known from the disclosure in the Japanese Patent No. 2770079 and Japanese Patent Application Laid Open No. 213958 of 1995. The electrostatic-painting painting apparatus of the external charging type is such that a high voltage is applied to an external electrode disposed in a position off an area sprayed with fine particles of a paint from the spray gun to cause discharging at the ground potential side of a to-be-painted object, to thereby form an electric field and charge the paint particles passing through the discharging area and carry them on an electric field formed toward the object, thereby promoting the paint particles to well adhere to the object. In comparison with the aforementioned direct charging technique, however, the paint particles passing through the discharging area cannot be charged so effectively as to assure a sufficient electrostatic effect.

Generally, the direct charging used mainly with a solvent-type paint is adopted in an electrostatic-painting spray gun usable effectively on the commercial base. In this case, the voltage applied to the electrode is on the order of −30 to −70 kV. The larger the potential difference, the greater the electrostatic effect is. However, because of a greater danger due to a spark discharge or shock discharge with application of a high voltage and the dielectric-strength design of the apparatus or the like, the applied voltage is required to be as low as possible. Therefore, the voltage applied to the electrode is about −50 kV in many cases. On the other hand, normally in the external charging, the electrode is applied with a voltage having a larger potential difference. In comparison with the direct charging technique in which the charging electrode is disposed in the center of paint spray for efficient charging, the external charging technique needs a higher voltage for a greater practical effect and the charging electrode is disposed ahead of the atomizer to prevent any dangerous discharging to the paint spray nozzle as a substantial ground potential side of the apparatus, and drop of the voltage caused by the discharging at the charging electrode.

Generally, the commercial-use spray gun is designed so that the charging electrode is positioned 80 to 150 mm ahead of the paint spray nozzle. Namely, the charging electrode is projected largely ahead of the paint spray nozzle. Therefore, many of the commercial-use spray guns are used as a hand-held automatic spray gun connected to, and driven by, an automatic painting apparatus in many cases. More specifically, in this hand-held spray gun, the charging electrode is projected largely ahead and positioned aside off the center axis of spraying to prevent the function from being lessened due to adhesion of the sprayed paint, with the result that the spray gun is a large and not easy to handle and operate. Thus, the worker engaged in painting with this spray gun will be correspondingly more burdened.

Also, a hand-held type electrostatic-painting spray gun is disclosed in the Japanese Patent Application Laid Open No. 30646 of 1978. In this spray gun, the electrode projected to the forward end of the gun leads to a poor operability and is likely to be broken due to collision during operation. These problems caused this spray gun not to be more popular. Also, in comparison with the direct charging technique in which the paint particles are directly charged, the extent of charging by discharging from the electrode disposed outside is rather smaller. Thus, the external charging technique is required to use a higher voltage for a higher degree of charging while assuring a higher safety and improve the efficiency of paint adhesion by the effective charging.

Since the aforementioned external charging cannot assure any sufficient charging, consideration should be given to the use of a higher voltage, measures against a danger and dielectric breakdown possibly caused by the application of the high voltage. Namely, the apparatus of this external charging type has many problems to solve, such as a compact design and practical applicability thereof as a hand-held spray gun.

Also, the painting spray guns including the electrostatic-painting spray gun and other types of spray guns are used each as an automatic spray gun in painting a series of many objects in a lot in an automated line of production in a factory. In a post along the production line where there is effected a painting upon which the quality of the paint film depends, the worker uses a hand-held spray gun in many cases. However, many of the spray guns of this hand-held type are problematic in safety and operability. Namely, improved ease of handling and operation of the spray gun leads directly to an improved economical efficiency such as higher efficiency of paint adhesion as well as to improved work efficiency, quality and stability of painting, which will be extremely important factors from the overall and long-term viewpoints.

The conventional electrostatic-painting spray guns are designed each for use as an automatic spray gun mounted on an automatic painting apparatus. Therefore, the hand-held type electrostatic-painting spray gun should be designed easier to handle and operate, strictly safer against possibly direct danger to the worker, and more compact.

Any external electrode to be provided in a conventional hand-held spray gun should be disposed largely ahead of the paint spray nozzle. Therefore, it is essential that the electrode should be lightweight. However, major consideration being given to a combination of necessary members in the spray gun, the problems for easier handling and operability of the spray gun, which are most important for the worker using the spray gun, have not yet been solved.

Also, in the case of the conventional hand-held type electrostatic-paining spray gun, a high-voltage cable from an external high-voltage generator is connected to the spray gun for receiving a high voltage. However, there have not yet been solved the problems such as incorporation, integrally in the spray gun, of the high-voltage generator to apply a voltage to the electrode in order to free the worker from the weight of the high-voltage cable and prevention of a danger of the high voltage applied to the electrode disposed ahead of the paint spray nozzle. The spray gun should be a comprehensively high-practicality one in which such solutions are implemented.

Also, if a paint is continuously sprayed with the paint being adhering to the external electrode and electrode holder or receptacle, the sprayed paint particles will be heaped up and drip off, which will spoil the quality of a finish coat. Of course, the spray gun with such a result is not reliably usable. In case a paint easily solidified and not soluble with the solvent, such as a water-based paint, is used, the solid content of the paint will act as an insulator and adhesion thereof to the electrode will greatly degrade the action and effect of the electrode. Therefore, the electrostatic-painting spray gun should be durable for a long term of use and able to readily be restored to its normal condition even if it should have the function thereof lessened or disabled.

SUMMARY OF THE INVENTION

Accordingly, the present invention has an object to overcome the above-mentioned drawbacks of the related art by providing an electrostatic-painting spray gun which is easy to handle and operate as a hand-held one, safe to the user thereof and can assure an improved efficiency of paint adhesion so that it will be able to contribute to the more popular use of water-based paints which are very friendly to the environment.

The above object can be attained by providing an electrostatic-painting spray gun including a high-voltage generator, atomizer, and an external electrode disposed outside, and projected ahead of the atomizer while being separated, with an electric insulation being kept, from a passage through which a paint is supplied to the atomizer, wherein the apparatus is a hand-held spray gun having an electroconductive grip provided at the back of the atomizer; and the external electrode can be connected to, and disconnected from, an electrode receptacle provided outside the apparatus. Because the external electrode is thus removable from the electrode receptacle, even if it is contaminated with the adhering paint and has the function thereof lessened or if it is broken due to collision during operation, it can readily be replaced and the spray gun can be restored to its normal condition.

For designing the external electrode so small as not to impair the operability of the spray gun, the electrode receptacle is disposed between the atomizer and the grip provided at the back of the atomizer. For the safety, a first high-resistance resistor is provided at the high voltage output of an electrical receptacle while a second high-resistance resistor is provided at the forward end of the external electrode, whereby it is possible to reduce the electrostatic capacity of the forward-end electrode charged with a high voltage.

Also, the external electrode has a plug-in portion so formed that the distance from a electric connection with the high voltage output of the high-voltage generator to the exposed end of the outer surface of the plug-in portion is sufficient for prevention of creepage discharging. Thus, even if an object acting as a ground potential is placed near the outer surface of the plug-in portion or under the influence of a contamination of the outer surface with the paint, it is possible to prevent creepage discharging of a high voltage to the forward end of the spray gun or to the ground potential side of the grip.

As a means for effectively preventing the creepage discharging in case the electrode receptacle and barrel of the spray gun are designed short, there is provided a corrugated or zigzagged boundary surface between the electric connection with the high-voltage output and the exposed end of the plug-in portion outer surface to be fitted in the electrode receptacle. To define the corrugated boundary surface, concentric deep grooves are formed in the electrode receptacle while corresponding ridges are formed in the plug-in portion of the external electrode. When the plug-in portion is fitted or plugged in the electrode receptacle with the ridges being inserted into the corresponding grooves, the corrugated boundary surface is defined to provide a long creepage distance which can prevent creepage discharging to the outer surface. Thus, the insulation between the electrode receptacle at a high voltage and the outer surface of the plug-in portion of the external electrode can be maintained, and the length of the electrode receptacle at the spray gun body and that of the external electrode which can freely be attached to, and removed from, the electrode receptacle can be reduced. Thereby, the hand-held spray gun can be handled more easily.

The present invention is further characterized in that the insulative material forming the external electrode is a flexible, resilient material to prevent the electrode body from being broken or deformed due to any unexpected collision or the like. The material will absorb the shock against a temporary deformation and prevent the electrode body from being broken. Thus, the electrode body is improved in durability. Also, according to the present invention, a portion of the electrode body is formed to be weaker than the other part. With this weak portion, it is intended that if the electrode body is broken under a large shock applied, the electrode body itself will just be disengaged from the electrode receptacle or partially broken without any critical damage to the electrode receptacle, namely, the application of a large shock will result in only a minimum damage, and the spray gun can quickly recover its normal condition only with replacement of the broken electrode body.

Also, the external electrode includes a charging electrode formed at the forward end thereof. With the forward end being positioned 30 to 80 mm ahead of the atomizer to prevent paint spray flow from being applied to the charging electrode. Also, with the forward end of the electrode being positioned as near to the paint spray flow as possible, it is possible to assure a highest efficiency of paint adhesion and safety.

The position where the charging electrode will not be applied with the paint spray flow is laterally separate from the center axis of spraying, and the distance from the center axis is not more than a half of the distance between the charging electrode and the front of the atomizer. Thereby, it is possible to prevent the sprayed paint particles from adhering to the charging electrode, so that the charging electrode can maintain the effect of charging the paint particles to assure a high electrostatic effect.

Also, the forward-end electrode, namely, the charging electrode, is positioned at such a distance as will not cause any streamer discharge having an electrically concentrated flow toward the paint spray flow or the paint spray nozzle at the ground potential side, and opened from the axis of spraying not to be applied with the paint spray flow.

To assure an efficiency of paint adhesion considered as effective with a practical electrostatic-painting spray gun, the charging voltage should be maintained at −70 to −90 kV, discharge current from the electrode be 60 to 150 μA, and a resistor of more than 150 MΩ is provided between the electrode and high voltage output for prevention of any dangerous shock discharging.

The external electrode is replaceable, and can be installed to the electrode receptacle at an angle for gradual separation from the center axis of spraying as it goes toward the forward end thereof so that it will not be applied with the paint spray flow. Also, the external electrode can easily be positioned appropriately for the length of the electrode body removably attached to the spray gun.

These objects and other objects, features and advantages of the present invention will become more apparent from the following detailed description of the best mode for carrying out the present invention when taken in conjunction with the accompanying drawings.

BRIEF DESCRIPTION OF THE DRAWINGS

The present invention will be described in detail concerning the embodiment thereof with reference to the accompanying drawings, in which.

DETAILED DESCRIPTION OF THE INVENTION

Figure 1:
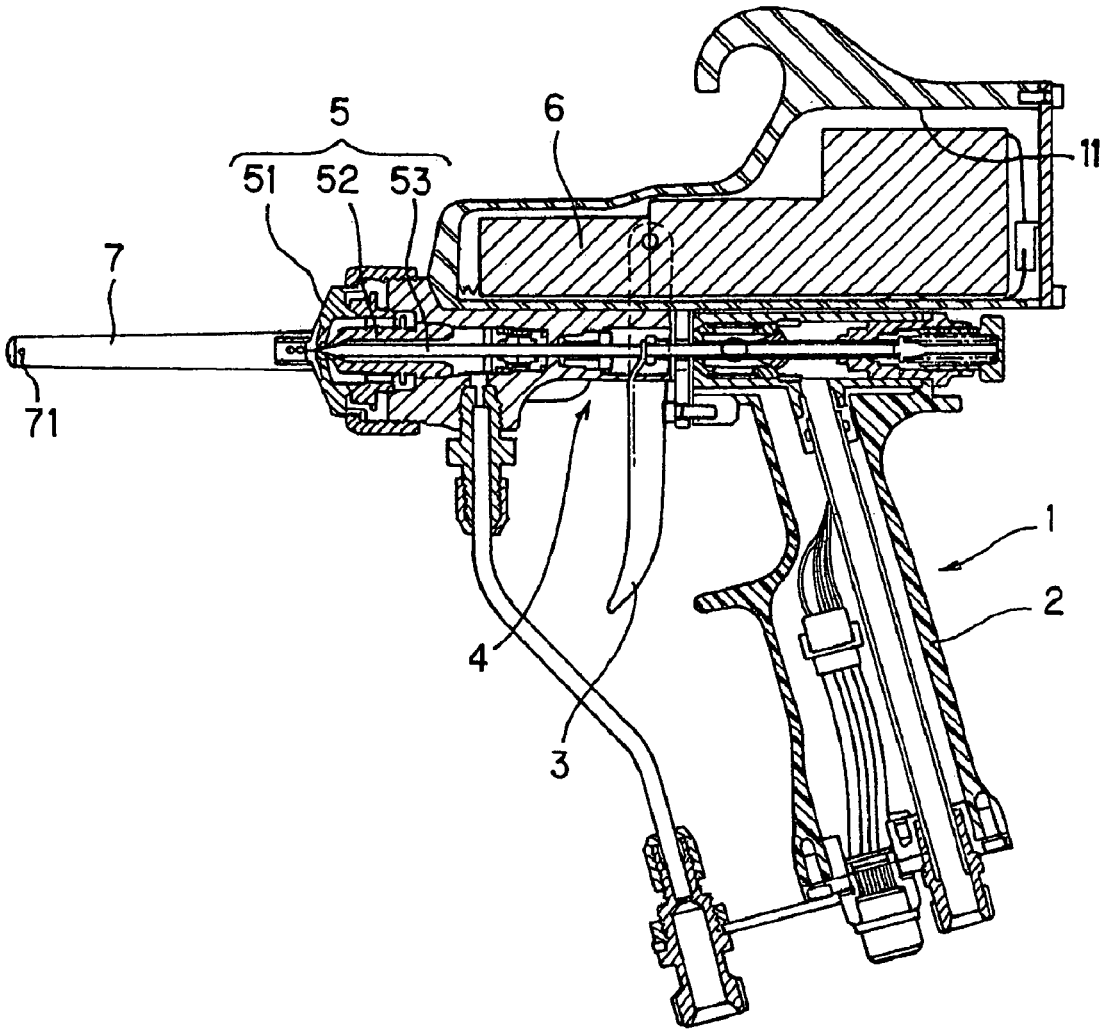
FIG. 1 is an axial-sectional view of an embodiment of the spray gun according to the present invention.

Referring now to FIG. 1, there is schematically illustrated in the form of an axial-sectional view the hand-held type electrostatic-painting spray gun adopting the external charging technique, as an embodiment of the present invention. The spray gun is generally indicated with a reference numeral 1. As shown, the spray gun 1 includes a grip 2, trigger 3, barrel 4, atomizer 5 provided at the forward end of the barrel 4, high-voltage generator 6 disposed at the top of the barrel 4, and an external electrode 7 provided outside the spray gun 1. The spray gun is to be operated while being held at the grip 2. The barrel 4 controls the paint to be sprayed from the atomizer 5 while controlling the high voltage for application to a forward-end electrode 71 of the external electrode 7 by controlling the input and output of a low-voltage power source for application to the high-voltage generator 6.

In this embodiment of the spray gun, the atomizer 5 atomizes a paint with a compressed air. For this purpose, an air cap or nozzle head 51 is provided around a paint spray nozzle 52 to form a desired pattern of spray for coating a to-be-painted object with the paint. The above construction is similar to that of the conventional spray gun. For the purpose of electrostatic painting, however, the barrel 4, paint spray nozzle 52 and air cap 51 are made of an electrically insulative material. In the spray gun used with a water-based or highly conductive paint and provided outside thereof with the charging electrode, since the paint passage is connected to the ground potential, a needle valve 53 in the paint spray nozzle 52 is made of a metal and thus electrically connected to the grip 2 located at the rear portion of the barrel 4. The grip 2 is electroconductive as in the conventional electrostatic-painting spray gun. In this embodiment, the grip 2 is made of such a semi-conductive resin as to have the ground potential when held in hand by the worker using the spray gun.

Figure 2:
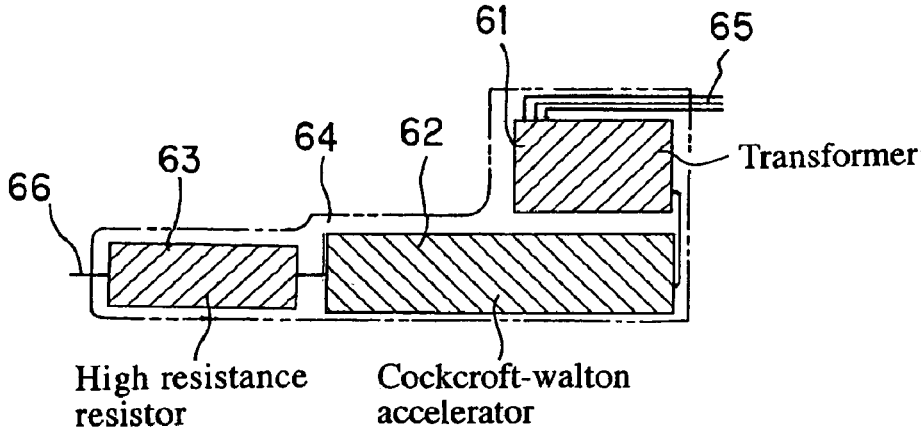
FIG. 2 schematically illustrates the construction of the high-voltage generator.
Figure 3:
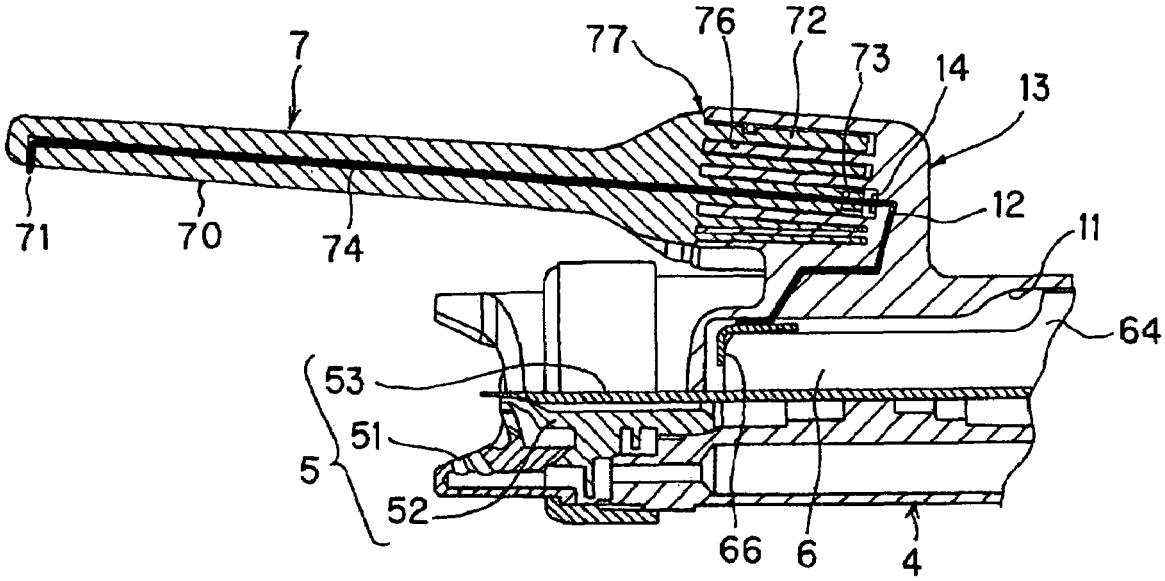
FIG. 3 is a partial axial-sectional view of the receptacle or holder for the external electrode.

As shown in FIG. 2, the high-voltage generator 6 includes a cartridge 64 formed by molding an insulative resin to house a low-frequency transformer 61, Cockcroft-Walton accelerator 62 and a protecting high-resistance resistor 63 together therein.

The cartridge 64 electrically maintains an insulating strength except at an input terminal 65 at the low-voltage input side and an output terminal 66 at the high voltage output.

The cartridge 64 is inserted in a housing 11 formed atop the barrel 4 of the spray gun 1 made of an insulative material, and the output terminal 66 of the high-voltage generator 6 is connected to one end of a conductor 12 laid extending through the barrel 4. An electrode receptacle 13 for receiving the external electrode 7 is also provided at the outer back of the atomizer 5 on the barrel 4 of the spray gun 1, and the other end of the conductor 12 is exposed as a connecting terminal 14 inside the electrode receptacle 13 made of an insulative material.

The forward-end electrode 71 is exposed at the forward end of the external electrode 7 which is to be fitted into the electrode receptacle 13, and a plug-in portion 72 is formed at the rear end of the external electrode 7. The external electrode 7 as a whole is made of an insulative material. A connecting terminal 73 is exposed at one end of the plug-in portion 72. A conductor 74 is connected between the connecting terminal 73 and forward-end electrode 71. When the external electrode 7 is inserted at the plug-in portion 72 thereof into the electrode receptacle 13 of the barrel 4, the connecting terminal 73 is put into contact with the connecting terminal 14 at the barrel 4 to have an electrical connection with the connecting terminal 14. In this embodiment, the connecting terminal 73 at the external electrode 7 is shaped in the form of a helical spring for positive connection, and the connecting terminal 14 at the barrel 4 may also be formed so.

Figure 4:
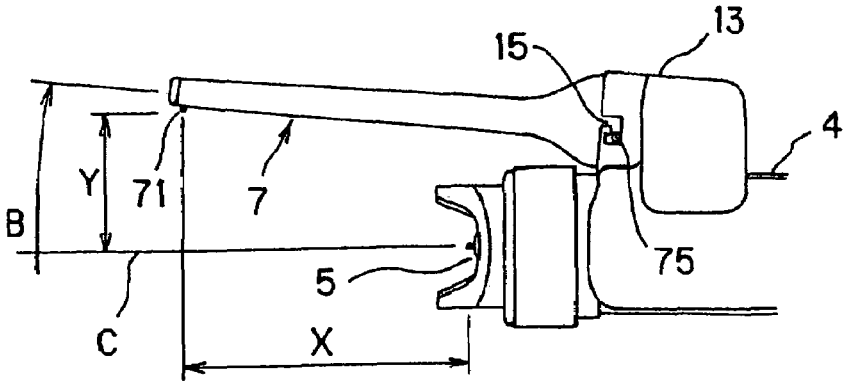
FIG. 4 explains the location where the external electrode is installed.

By inserting the plug-in portion 72 of the external electrode 7 into the electrode receptacle 13 and turning it a little until an engagement piece 75 is engaged in a retention recess 15, the external electrode 7 can be fixed to have the forward-end electrode 71 thereof locked in place as partially shown in FIG. 4. The forward-end electrode 71 may be locked otherwise. That is, it may be locked so with a conventional engaging technique, namely, by a selected one of a technique in which the engagement piece 75 is simply inserted into the retention recess 15 for close fitting due to their dimensional precision to assure a necessary force of fixation based on a force of friction, and a technique in which both the engagement piece 75 and retention recess 15 are formed so that they can be put into mesh with each other and disengaged from each other by releasing the engagement piece 75.

The external electrode 7 is easily replaceable because it is simply configured and can be easily attached to, and removed from, the electrode receptacle 13. Even if the forward-end electrode 71 is contaminated with the paint or broken during paint spraying, the external electrode 7 can readily be replaced to assure a continuous work of painting without any long interruption. Because the electrode receptacle 13 is disposed at the back of the atomizer 5, only the forward end of the external electrode 7, which is shaped thin, can be placed in an area sprayed with paint particles and in a position so near the object as to charge the sprayed paint particles effectively within a range of no influence on the spraying.

Figure 5:
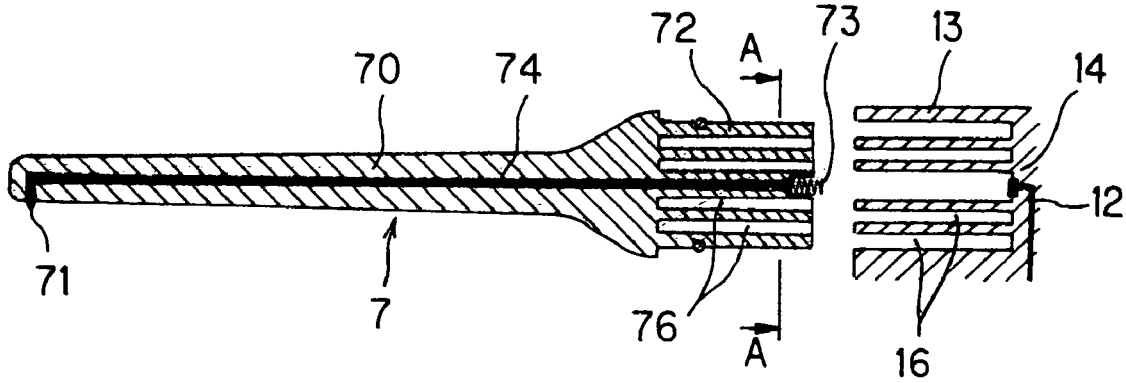
FIG. 5 is an axial-sectional view of the external electrode.
Figure 6:
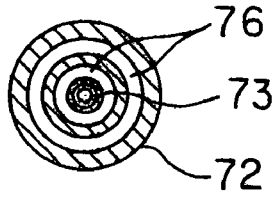
FIG. 6 is a cross-sectional view taken along the line A-A in FIG. 5.

The plug-in portion 72 of the external electrode 7 has concentric deep grooves 76 formed therein about the conductor 74 and connecting terminal 73 and the electrode receptacle 13 of the barrel 4 has formed therein concentric grooves 16, as shown in FIG. 5. Thus, each of the plug-in portion 72 of the external electrode 7 and the electrode receptacle 13 has the grooves and ridges (i.e., projections), and the plug-in portion 72 is fittable into the electrode receptacle 13 with the ridges being received in the respective grooves. With the external electrode 7 being inserted at the plug-in portion 72 into the electrode receptacle 13 of the barrel 4, the creepage surface (creepage length) along the corrugated boundary surfaces, defined by the grooves 16 and ridges, of the electrode receptacle 13 extends to an exposed end 77 at the outer surface of the electrode receptacle 13. Therefore, since a sufficient creepage-discharge prevention distance to the exposed end 77 at the outer surface of the electrode receptacle 13 is ensured for a high voltage applied to the connecting terminal 73, even if a to-be-painted object at the ground potential touches the exposed end 77 at the outer surface, it is possible to prevent any unexpected discharge or dielectric breakdown from taking place.

Normally, the creepage-discharge prevention distance should be about 15 mm per 10 kV. According to the present invention, the creepage length of the electrode receptacle 13 can be sufficient because of the corrugated or zigzagged boundary surfaces, defined by the grooves 16 and ridges of the electrode receptacle 13 and grooves 76 and ridges of the plug-in portion 72 of the external electrode 7. The plug-in portion 72 of the external electrode 7 can be formed shorter accordingly, and thus the spray gun itself can also be formed correspondingly shorter for easier handling.

Since a high voltage is applied via the protecting high-resistance resistor 63 to the high voltage output terminal 66 of the high-voltage generator 6 provided at the spray gun 1, the external electrode 7 is not electrically shocked accidentally.

Figure 7:
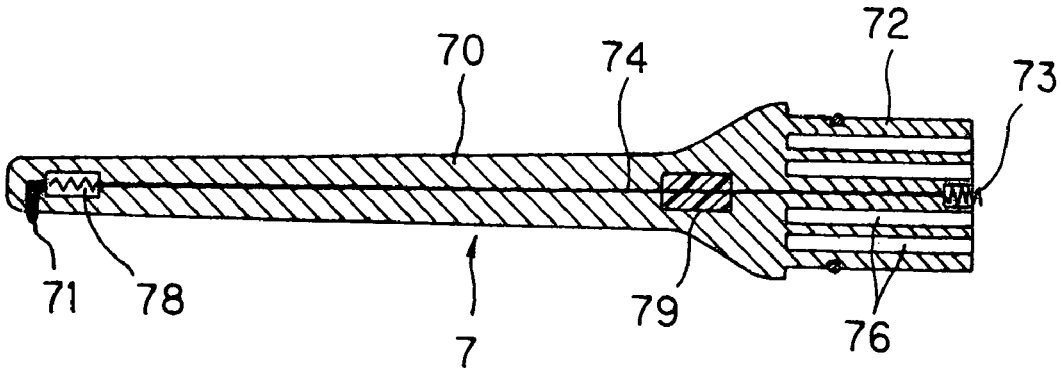
FIG. 7 is an axial-sectional view of the external electrode.
Figure 8:
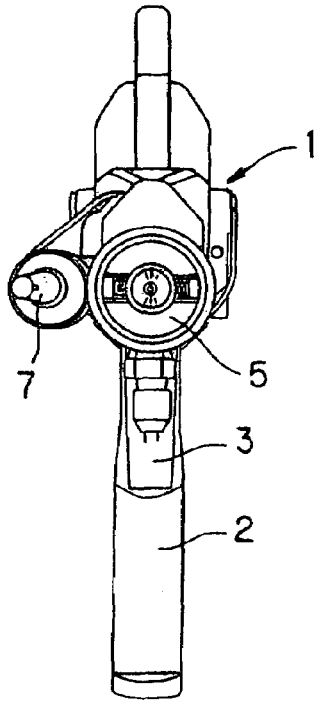
FIG. 8 is a side elevation, viewed from the forward end, of the spray in FIG. 1.

However, the static charge in the conductor 74 extended through the external electrode 7 will inevitably be discharged suddenly. On this account, a second high-resistance resistor 78 is provided as a current-limiting resistor in the vicinity of the forward-end electrode 71 of the external electrode 7 as shown in FIG. 7 to assure a higher safety. The second high-resistance resistor 78 has a size selected for the external electrode 7 not to impair the ease of operation and handling of the spray gun.

Thus, such use of the second high-resistance resistor 78 allows the protecting high-resistance resistor 63 provided at the high-voltage generator 6 to be smaller in size, which will contribute to a reduced size of the high-voltage generator 6 and thus to a more compact and lightweight design of the spray gun itself.

Further, according to the present invention, the external electrode 7 is made of a flexible, resilient material. More specifically, an electrode body 70 is formed from a resin such as polyethylene to protect the electrode body 70 from being broken due to an accidental drop, collision with any object or the like during operation and handling of the spray gun.

Also, according to the present invention, a part 79 of the external electrode 7 is made of a material low in bending strength to make the electrode receptacle 13 at the spray gun body side relatively stronger. This feature will assure that even if the external electrode 7 is given a heavy mechanical shock, the electrode body 70 will only be broken at that weak portion 79 and the spray gun 1 can quickly recover its normal condition only with replacement of the electrode body 70.

According to the present invention, the external electrode 7 is positioned under the following conditions.

As shown in FIG. 4, the forward-end electrode 71 of the external electrode 7 connected to the electrode receptacle 13 is positioned 70 mm (X in the drawing) ahead of the forward end of the paint spray nozzle 52 of the atomizer 5, and 30 mm (Y in the drawing) laterally away from the longitudinal axis (C in the drawing) of spraying.

The electrode receptacle 13 at the barrel 4 is formed at an angle B of about 10 deg. outwardly divergent from the longitudinal axis C of spraying. Thus, the external electrode 7 is more distant from the longitudinal axis C of spraying as it is nearer to the forward end thereof. Therefore, with a spraying rate and spreading of the paint spray falling within the range of requirements for the normal painting, the paint will not adhere to the forward-end electrode 71 positioned as in this embodiment and thus the paint spraying can continuously be done without interruption. When the voltage application and other painting conditions are changed, however, the positioning of the external electrode 7 should be changed in some cases. Also, with a longer external electrode 7, the forward-end electrode 71 can be positioned more distant from the paint spray nozzle 52 and also from the axis of spraying to prevent the paint from adhering to the forward-end electrode 71.

Figure 9:
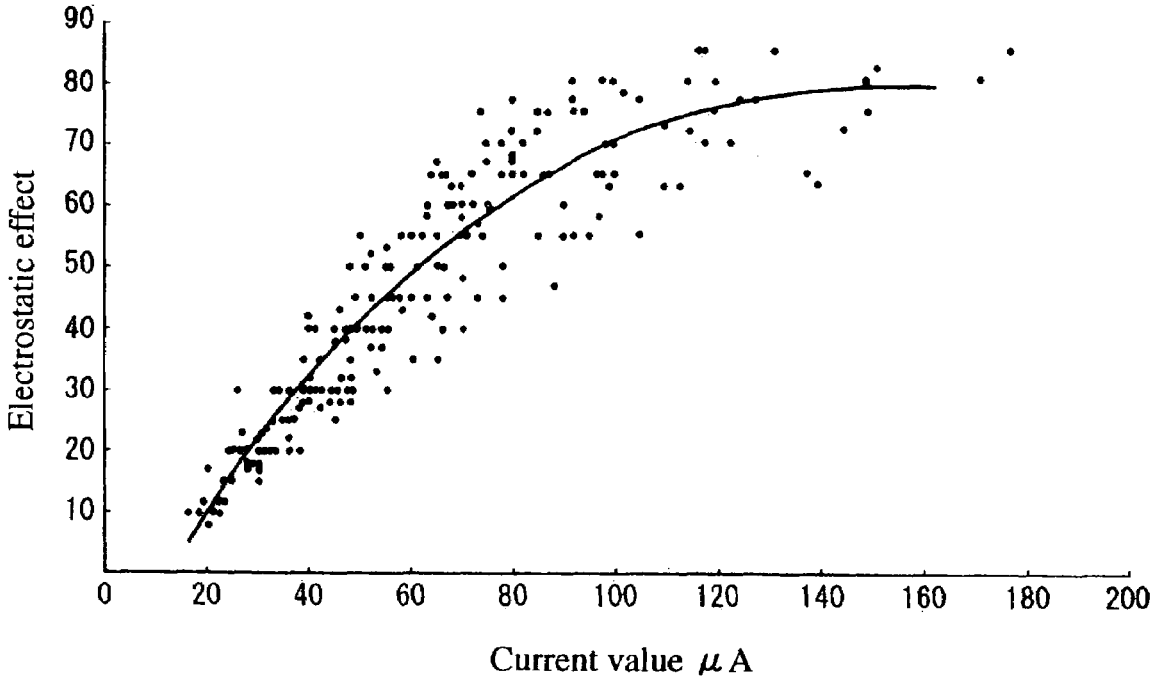
FIG. 9 graphically illustrates the tendency of the electrostatic effect on the current from the electrode.
Figure 10:
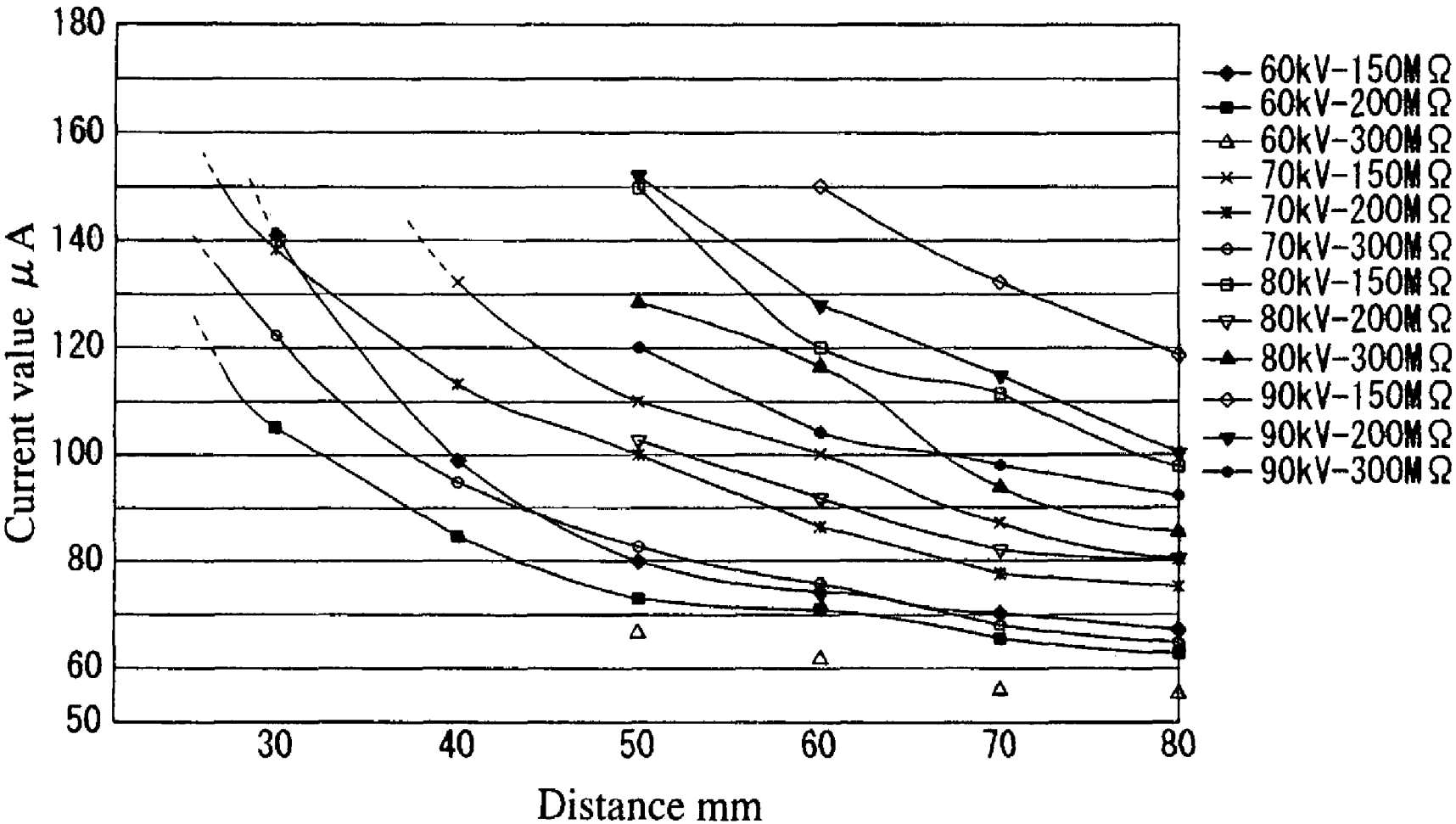
FIG. 10 graphically illustrates the test results showing the variation of current depending upon the position of the external electrode.

The results of various tests made by the Inventors of the present invention revealed that the efficiency of paint adhesion in the electrostatic painting with the external charging should be about 10% higher than in the painting with no voltage application, namely, in the ordinary painting. On this account, the voltage for application to the external electrode 7 should be −70 to −90 kV, which is higher than that used in the electrostatic painting with the direct charging. Thus, some safety measures should be taken. The protecting high-resistance resistor 62 is provided at the output of the high-voltage generator 6 to limit the discharge current to 200 μA for assuring the safety when the forward-end electrode 71 is near the ground potential. The protecting high-resistance resistor 62 should have a resistance of at least 150 Ma When a paint is actually sprayed, the current is reduced to about 150 μA, and this current value is taken as the maximum current value for the electrostatic painting. The Inventors of the present invention conducted many tests under the practical, average painting conditions including a spraying pressure of 300 kPa, spraying distance of 300 mm, paint spraying rate of 300 ml/min, current-limiting resistance of 150 to 300 MΩ, distance of 30 to 80 mm between the forward-end electrode 71 and the paint spray nozzle and a charging voltage of 30 to 90 kV. The test results are shown in FIG. 10. As graphically shown in FIG. 9, the electrostatic effect was found improved for a current of about 120 μA. With charging with a higher voltage, however, no remarkable change was found but the danger will be rather higher. Therefore, the maximum current should be 120 μA.

The current of 150 μA, which is considered to have no danger to the apparatus and human body, did not result in any difference in substantial effect. Contrarily, with a current of about 60 to 70 μA, the electrostatic effect was abruptly lower. Namely, such values of the current are practically useless.

With the use of a higher-resistance resistor, the safety will be correspondingly higher but the current will be smaller. No sufficient discharge will take place, resulting in poorer charging of the paint particles and lower electrostatic effect. Therefore, the high resistance of 300 MΩ is taken as the practically highest one.

The electrostatic effect referred to herein is of such an extent that the paint spray ill flow around and adhere to sides and back of a to-be-painted object, other than a to-be-painted surface the spray flow will apply directly. The higher the electrostatic effect, the better the paint will adhere to a to-be-painted object, so that of the electrostatic painting, the process can be reduced and efficiency be improved effectively. Also, it has also been proved that the electrostatic effect is in correlation with the efficiency of paint adhesion.

Further, the forward-end electrode 71 of the external electrode 7 is positioned as follows. It is well known that when discharging is made from the electrode at a high voltage to the paint spray nozzle 52 at the ground potential side or to paint particles being sprayed, the longer the distance between the electrode and nozzle or paint particles, the larger the current is. However, the electrostatic painting needs discharging with a high efficiency of ionization, and if the distance is so short that a discharge current is focused on the paint spray nozzle 52, no electrostatic effect will be obtainable. The results of many tests made by the Inventors of the present invention showed that when the spray gun is used under the practically applicable painting conditions, the forward-end electrode 71 should be positioned 30 mm or more off a position where the paint spraying is started, that is, a position where the paint atomization is started.

More particularly, in case the practically required charging voltage is −70 kV and a resistor having a high voltage of 200 MΩ is used in the spray gun, the position of the forward-end electrode 71 where a current of 120 to 150 μA can be sustained is about 30 mm ahead of the atomization starting position. If this distance is shorter, a streamer discharge will take place, and the discharge current rises abruptly to lower the safety. Therefore, in case a current-limiting resistance of 300 MΩ is selected as above to maintain the efficiency of paint adhesion, the shortest distance to the forward-end electrode 71 should desirably be about 30 mm.

Also, in case the forward-end electrode is positioned over the predetermined distance or a longer distance, the discharge current almost depends upon the aforementioned resistance of the current-limiting resistor. It is stable and no marked change is found in the electrostatic effect, as shown in FIG. 10. Therefore, with consideration given to the safety, the forward-end electrode is positioned in a remote position where the electrostatic effect will little be affected, namely, in the intermediate position in relation to an object to be painted.

With the ease of handling the spray gun being taken in consideration, however, it is apparent that the electrode laid ahead of the atomizer should desirably be small and positioned nearer to the atomizer. The positioning as in this embodiment will permit to implement safe and highly efficient electrostatic painting.

On the other hand, since the paint spray flows in a predetermined spread toward a to-be-painted object in the practical painting, it is also an important factor for the spray gun that for prevention of the paint spray from applying the forward-end electrode, the latter should be positioned so distant from the atomizer as to positively prevent the paint particles from adhering to the electrode. The paint adhering to the electrode will insulate the electrode and thus block discharging from the electrode. In this case, the electrostatic effect will abruptly be lower.

According to the present invention, the forward-end electrode 71 is positioned as near the axis of spraying as possible to prevent the paint spray from applying the electrode 71. In the spray gun, the forward-end electrode 71 is positioned at a shorter radius of an elliptical spray pattern. At this shorter radius of the spray pattern, the spread of spray is stably small. At the start point of spraying, the spray will abruptly spread. Thereafter, the spraying is made in a stable spread of about 10 deg. in angle as in the spread of the spraying air flow.

Note that the external charging type electrostatic-painting spray gun is to be used for spray-painting of a conductive paint such as a water-based paint. Fine particles of the paint sprayed from the atomizer are charged when passing through an area of ionization formed due to discharge from the forward-end electrode provided ahead of the atomizer, and electrostatically adhere to a to-be-painted objected placed opposite to the electrode. It should be noted that the atomizer is not limited to the one used in the air spray gun according to the embodiment of the present invention.

As having been described in the foregoing, since the external electrode can simply be attached to, or removed from, the hand-held electrostatic-painting spray gun incorporating the high-voltage generator, the spray gun can be used being held in hand under different painting conditions. Namely, the present invention can provide a high-practicality electrostatic-painting spray gun of the external charging type, excellent in ease of operation and handling.

Also, since the forward-end electrode of the external electrode is located in a position where it will work most effectively, the electrostatic effect is highest and efficiency of paint adhesion is improved.

Further, because of the corrugated boundary surface of the external electrode, a necessary creepage-discharge prevention distance can be assured. So, the external electrode itself can be designed smaller and thus the spray gun itself can be designed compact. Thus, the present invention can solve the problems for easy installation, and improved ease of handling and operability of the spray gun.

Furthermore, since the external electrode is designed simplest and easily replaceable, breakage thereof will not lead to any damage of the spray gun body. Only with replacement of the external electrode which is inexpensive as above, the spray gun once put out of operation can quickly recover the normal condition. Thus, the damage can be minimized and the down time is shortest.

INDUSTRIAL APPLICABILITY

In the field of electrostatic paint, there have been used mainly the solvent-type paints whose electric resistance is high. Because of the recent movement for being friendly to the earth, it has been demanded to limit the use of the solvent type paints containing a volatile organic compound, and use the water-based paints instead. To solve the problems such as the possible danger caused by the use of a water-based paint or metallic paint whose electric resistance is low and large size of the painting apparatus, which causes the use of such water-based paint and metallic paint not to have been more prevailing, the present invention provides an electrostatic-painting spray gun including an external electrode which can freely be attached to, and removed from, the spray gun and a high-voltage generator, and which is highly safe, excellent in ease of handling and operation, and capable of an optimum efficiency of painting. The spray gun according to the present invention will be able to contribute much to the use of more water-based paint which is friendly to the environment.

The invention claimed is:

1. An electrostatic-painting spray gun comprising:

an atomizer provided at a forward end of the spray gun;

an external charging electrode disposed at an outer portion of the spray gun so as to project ahead of the atomizer, the external charging electrode being separated from a passage through which paint is to be supplied to the atomizer, with an electric insulation of the external charging electrode being maintained; and an electrode receptacle provided at an outer portion of the spray gun, an output terminal of a high voltage generator being connected to the electrode receptacle, wherein the external electrode is freely attachable to and removable from the electrode receptacle, the electrode receptacle having a plurality of grooves formed along an outer surface of the electrode receptacle so as to define a plurality of projections, wherein the external electrode includes an electrode body formed from an insulative material, the electrode body having a charging electrode provided so as to be exposed at a forward end thereof and a plug-in portion formed at a rear end thereof, the plug-in portion having a connecting terminal arranged to electrically connect to the electrode receptacle so as to conduct electricity from the electrode receptacle to the charging electrode, the plug-in portion having a plurality of grooves formed along an outer surface of the plug-in portion so as to define a plurality of projections, the plug-in portion being attachable to the electrode receptacle by inserting the projections of the plug-in portion into respective grooves of the electrode receptacle and by inserting the projections of the electrode receptacle into respective grooves of the plug-in portion, and wherein a corrugated boundary surface formed by outer surfaces of the grooves and projections of the electrode receptacle and the plug-in portion is defined between an exposed end of the outer surface of the plug-in portion and an electrical connection formed between the connecting terminal and the electrode receptacle so as to provide a long creepage distance.

2. The spray gun according to claim 1, wherein at least a portion of the electrode body comprises a bendable portion formed of a flexible or resilient material.

3. The spray gun according to claim 1, wherein at least a portion of the electrode body is formed of a material having a lower strength than that of the electrode receptacle.

* * * * *